US005571028A

United States Patent [19]

Szegda

[11] Patent Number: 5,571,028

[45] Date of Patent: Nov. 5, 1996

[54] COAXIAL CABLE END CONNECTOR WITH INTEGRAL MOISTURE SEAL

[75] Inventor: Andrew Szegda, Canastota, N.Y.

[73] Assignee: John Mezzalingua Assoc., Inc., East Syracuse, N.Y.

[21] Appl. No.: 519,654

[22] Filed: Aug. 25, 1995

[51] Int. Cl.[6] ..... H01R 4/38

[52] U.S. Cl. ..... 439/322; 439/339; 439/277; 439/583

[58] Field of Search ..... 439/320, 321, 439/322, 339, 340, 271, 272, 277, 583, 584; 411/369, 542

[56] References Cited

U.S. PATENT DOCUMENTS

| | | |
|---|---|---|
| 2,560,092 | 7/1951 | De La Mater . |
| 2,772,903 | 12/1956 | Sussenbach . |
| 3,184,769 | 5/1965 | Barwood . |
| 3,316,952 | 5/1967 | Hollinger . |
| 3,661,046 | 5/1972 | Waud et al. . |
| 3,788,185 | 1/1974 | Gutshall . |
| 4,004,626 | 1/1977 | Biblin et al. . |
| 4,023,882 | 5/1977 | Pettersson . |
| 4,047,743 | 9/1977 | Weintraub et al. . |
| 4,126,170 | 11/1978 | DeHaitre . |
| 4,292,876 | 10/1981 | De Graan . |
| 4,447,103 | 5/1984 | Werth et al. . |
| 4,611,872 | 9/1986 | Ito et al. . |
| 4,614,390 | 9/1986 | Baker . |
| 4,621,963 | 11/1986 | Reinwall . |
| 4,702,657 | 10/1987 | Jelinek . |
| 4,707,047 | 11/1987 | Michaels et al. . |
| 4,749,321 | 6/1988 | Knohl et al. . |
| 4,859,200 | 8/1989 | McIntosh et al. . |
| 4,869,679 | 9/1989 | Szegda . |
| 4,924,533 | 5/1990 | Stairs, Jr. . |
| 5,141,375 | 8/1992 | Pollizzi . |
| 5,156,509 | 10/1992 | Wu . |

FOREIGN PATENT DOCUMENTS

| | | |
|---|---|---|
| 4-223075 | 8/1992 | Japan . |
| 119539 | 10/1918 | United Kingdom . |
| 1047764 | 11/1966 | United Kingdom . |

OTHER PUBLICATIONS

Augat Pamphlet—*Introducing the LRC Snap-N-Seal™ F Connector.*, "Positive Seal. And Zero Leakage to Boot."

*Primary Examiner*—Khiem Nguyen
*Attorney, Agent, or Firm*—Samuels, Gauthier, Stevens & Reppert

[57] ABSTRACT

An end connector for a coaxial cable has a rotatable nut with an internal thread configured and dimensioned to coact in threaded engagement with a complimentary external thread on a system component. A circular seal element is contained within and axially fixed with respect to the nut. The seal element is deformable into a configuration lining at least a portion of the internal thread to thereby establish a barrier to the penetration of moisture between the interengaged internal and external threads.

14 Claims, 3 Drawing Sheets

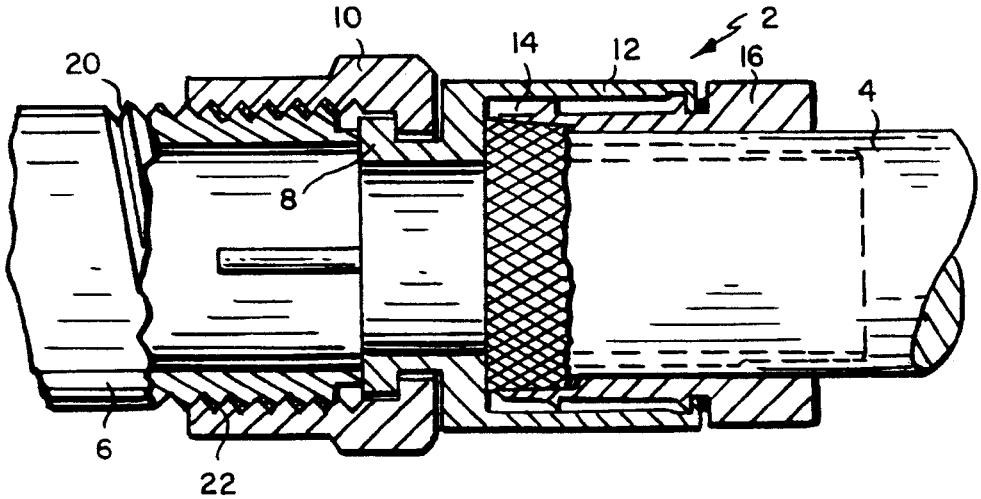
FIG. 1
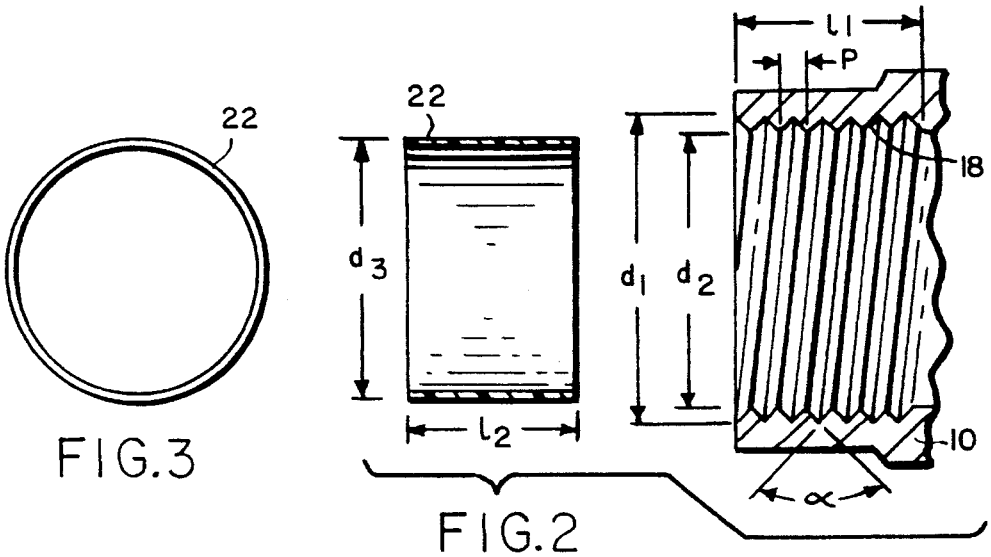
FIG.3
FIG.2
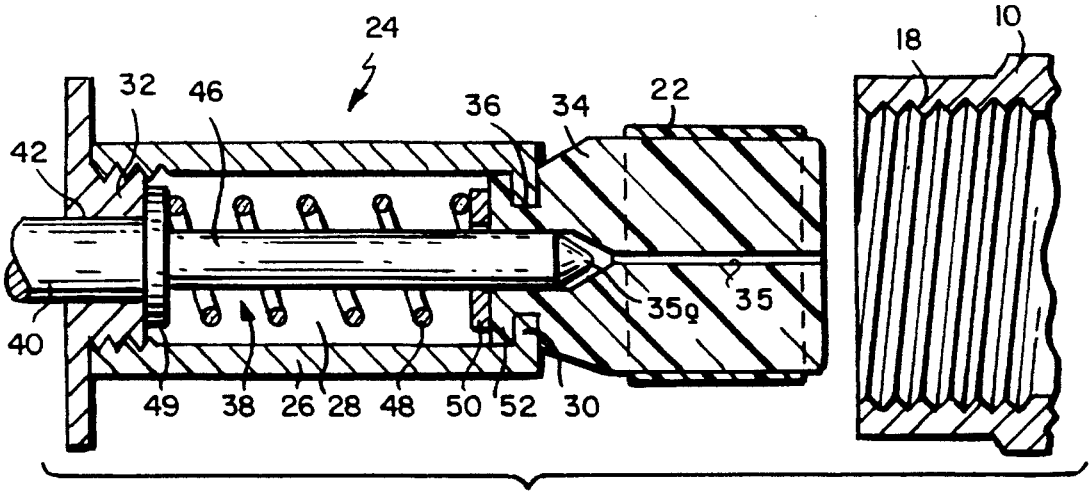
FIG. 4

COAXIAL CABLE END CONNECTOR WITH INTEGRAL MOISTURE SEAL

BACKGROUND OF THE INVENTION

1. Field of the Invention

This invention relates to coaxial cable end connectors having nut members adapted to be threaded onto equipment ports or the like, and is concerned in particular with an improved sealing arrangement for preventing moisture from penetrating between the coactively engaged threads of such components.

2. Description of the Prior Art

The prior art is generally cognizant of various sealing arrangements for use between the male threads of equipment ports and the female threads of cable end connectors. For example, it is known to apply liquid or strand-like sealing materials to one or both of the male and female threads as a preliminary step in the interengagement process. In such cases, the integrity of the resulting seal is largely dependent upon the care with which the sealing material is applied. Thus, when cable installers and maintenance personnel are called upon to work under stressful or adverse climatic conditions, proper application of sealing materials is often neglected, resulting in leakage related problems.

Various so-called "self-sealing" nuts have been developed, as disclosed for example in U.S. Pat. Nos. 4,004,626 (Biblin et al); 4,126,170 (DeHaitre); and 4,707,047 (Michaels et al). These rely on the compression of a sealing material located adjacent to but outside of either the entry end or the exit end of the female thread, and require adequate tightening of the nut to achieve optimum sealing. Such self-sealing nuts may not be tightened sufficiently during initial engagement, or they may subsequently loosen, the result again being an inadequate seal.

It is also known to apply rubber-like sleeves to the male threads of the equipment ports prior to engagement of the connector nuts. Here again, sealing integrity can be compromised by a failure on the part of the installer to fully tighten the nut.

Accordingly, a need exists for a coaxial cable end connector having a nut member with a sealing arrangement which addresses and either obviates or at the least substantially minimizes the above-noted shortcomings of the prior art.

A primary objective of the present invention is the provision of a coaxial cable end connector having a rotatable nut member with an integrally associated internal sealing element configured and dimensioned to be readily deformed into a tightly sealed relationship between the internal thread of the nut member and the external thread of a port or other like system component onto which the nut is threaded.

Another objective of the present invention is the provision of a seal which provides reliable moisture-tight integrity irrespective of the extent to which the nut member is initially tightened.

A companion objective of the present invention is the provision of a seal which retains its moisture-tight integrity in the event that the nut member subsequently loosens.

Still another objective of the present invention is the provision of an improved seal which is factory-installed as an integral part of the nut member, thus obviating the drawbacks associated with prior art seals requiring careful application of a sealing material as a preliminary step to installation of the cable end connector.

SUMMARY OF THE INVENTION

In accordance with the present invention, the nut member of a coaxial cable end connector is provided with a sealing element positioned within and deformed into interengagement with its internal thread. The sealing element is axially fixed intermediate the internal thread ends, and has an inner diameter sized for engagement and deformation by the external thread of a port or other like system component onto which the nut is threaded during attachment of the end connector. The thus deformed sealing element reliably prevents moisture penetration between the interengaged internal and external threads.

BRIEF DESCRIPTION OF THE DRAWINGS

FIG. 1 is a longitudinal section through a coaxial cable end connector having a nut member with an integrally associated seal element in accordance with the present invention, the end connector being shown secured to an end of a coaxial cable, with the nut member threaded onto an equipment port;

FIG. 2 is an enlarged partial sectional view of the nut member with the sealing element shown axially separated therefrom;

FIG. 3 is an end view of the seal element shown in FIG. 2;

FIG. 4 is an illustration of a tool for inserting the seal element into the nut member, with the seal element shown prior to insertion;

DETAILED DESCRIPTION OF THE ILLUSTRATED EMBODIMENTS

Figure 5:
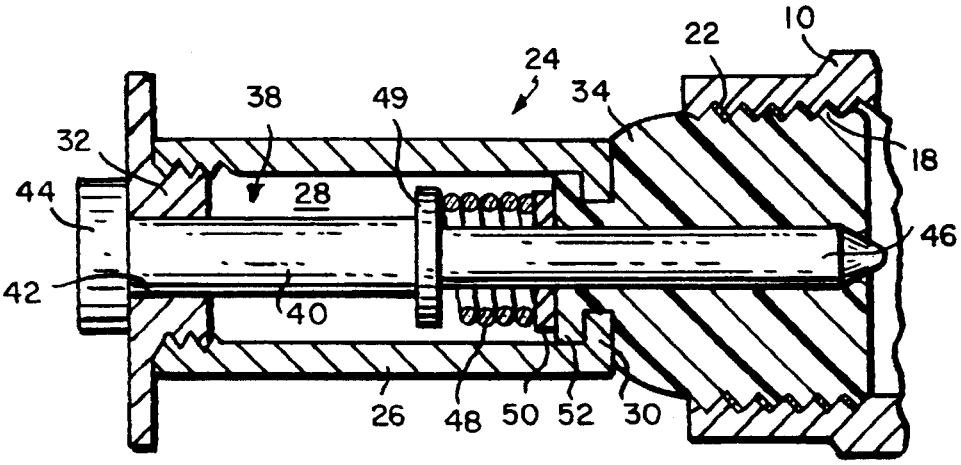
FIG. 5 is an illustration similar to FIG. 4 showing the seal element inserted into the nut member and deformably expanded by the tool member.

With reference initially to FIG. 1–3, an end connector 2 is shown coupling one end of coaxial cable 4 to an equipment port 6. End connector 2 is of the radial compression type described in copending U.S. patent application Ser. No. 08/304,562 filed Sep. 12, 1994, the disclosure of which is herein incorporated by reference in its entirety. The end connector has a tubular body 8 having a front end supporting a rotatable nut member 10, and a rear end adapted for insertion into the end of the cable 4. The connector body 8 further includes an integral outer collar 12 surrounding and fixed relative to the rear end of the connector body to define an annular chamber 14. A tubular locking member 16 protrudes into the annular chamber 14 and cooperates with the collar 12 and rear end of the body 8 when in its clamped position as shown in FIG. 1 to fix the connector to the cable end. The nut member 10 has an internal thread 18 adapted to coact in threaded engagement with an external thread 20 on the port 6. A sleeve-like sealing element 22 is interposed between the coactively engaged threads 18, 20 to provide a barrier against the penetration of moisture therebetween.

The internal thread 18 has an axial length $l_1$, major and minor diameters $d_1$, $d_2$, a pitch p and thread angle ∝ configured to coact in threaded engagement with the external thread 20 on the port 14. The seal element 22 is circular in cross section, extruded or otherwise formed of a non-metallic yieldably deformable material, and with an axial length $l_2$ greater than the pitch p and preferably only slightly shorter than the axial length $l_1$ of the internal thread 18. In the unexpanded condition shown in FIGS. 2 and 3, the outer diameter $d_3$ of the seal element 22 is slightly smaller than the minor thread diameter $d_2$. A preferred material for the seal element 22 is polytetrafluoroethylene ("PTFE").

The seal element 22 is factory-installed in the nut member 10 by any convenient means, such as for example the tool 24 illustrated in FIGS. 4 and 5. Tool 24 includes a tubular barrel 26 defining an interior chamber 28 closed at one end by wall 30 and closed at the opposite end by plug 32. One end of a resiliently expandable mandrel 34 protrudes through an opening 36 in wall 30. Mandrel 34 has a central passageway 35 with an enlarged diameter entry end 35*a*. A plunger 38 is located in the chamber 28. Plunger 38 has a barrel 40 which protrudes through an opening 42 in plug 32 to terminate in an enlarged diameter external head 44, and a stem 46 aligned axially with, and as shown in FIG. 4, protruding into the entry end 35*a* of the passageway 35 in the mandrel 34. A compression spring 48 surrounds the stem 46 and is confined axially between an annular shoulder 49 on the plunger 38 and a washer 50 bearing against an annular collar 52 on the mandrel 34, the collar 52 being held against the end wall 30 by the spring 48 acting through the washer 50.

As shown in FIG. 4, the seal element 22 is axially mounted over the exposed end of the mandrel 34. As can be further seen by reference to FIG. 5, the thus mounted seal element is then inserted into the nut member 10, after which the plunger 38 is advanced to force the stem 46 along the central passageway 35 of the mandrel 34. The mandrel is thus expanded radially, causing the seal element 22 to be radially expanded and to become permanently deformed into the internal thread 18. The stem 46 is then retracted from the mandrel 34 under the action of spring 48, thus allowing the mandrel to radially retract to its original diameter, and permitting the mandrel to be withdrawn from the expanded seal element.

The mandrel may alternatively be fabricated as a split metallic sleeve, the external surface of which may additionally be threaded or serrated.

Figure 6:
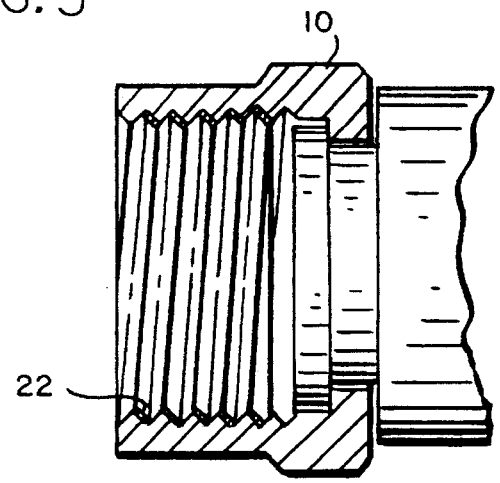
FIG. 6 is an illustration showing the seal element following its insertion into the nut member.

As shown in FIG. 6, the seal element 22 remains deformed into and mechanically interengaged with the internal thread 18, and as such is axially anchored within the nut member 10. The seal element 22 thus lines at least a portion of the axial length $l_1$ of the internal thread 18 at a location intermediate its ends. The seal element is expanded beyond the minor diameter $d_2$ and well into the internal thread 18, with portions of the seal element being hard up against the base of the internal thread at its major diameter $d_2$.

The wall thickness of the seal element 22 is dependent upon thread tolerances, and is selected to achieve the desired moisture-tight seal. For a typical cable end connector application, the wall thickness of the seal element will range from about 2 mils to 8 mils, and for most applications will be about 5 mils. The axial expansion and accompanying permanent deformation of the seal element 22 into a secure mechanical interlock with the internal thread 18 will resist any tendency of the seal element to drop out or otherwise become dislodged from the nut member during shipment and subsequent use.

Figure 9:
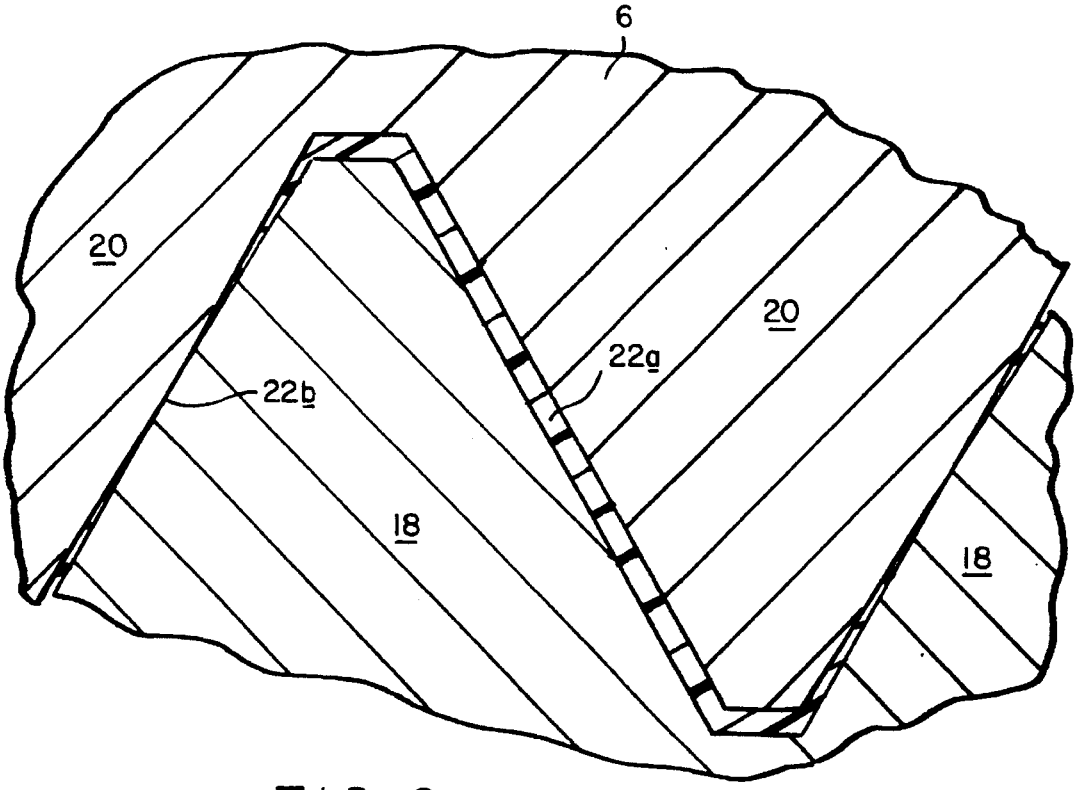
FIG. 9 is a greatly enlarged partial sectional view of interengaged male and female threads, showing the manner in which the seal element is deformably arranged and partially punctured therebetween.

As can best be seen by further reference to FIG. 9, when the nut 10 is threaded onto the equipment port 6, the seal element 22 is extruded between the male and female threads 20, 18. A portion of the seal material builds up as at 22*a* to establish the moisture barrier, whereas at 22*b*, the seal material is punctured to establish electrical contact between the interengaged threads.

Figure 7:
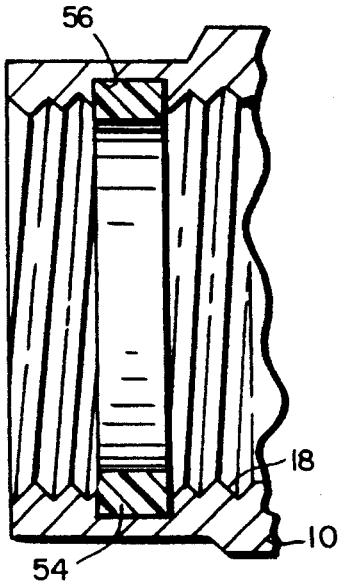
FIGS. 7, 7A, 8 and 8A are enlarged partial sectional views of the nut member showing alternative embodiments of seal elements in accordance with the present invention.
Figure 7A:
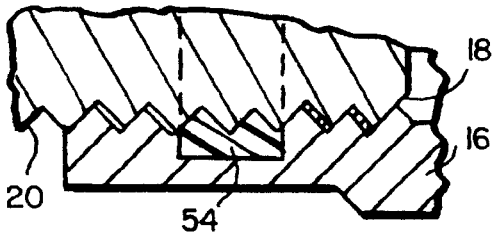
Figure 8A:
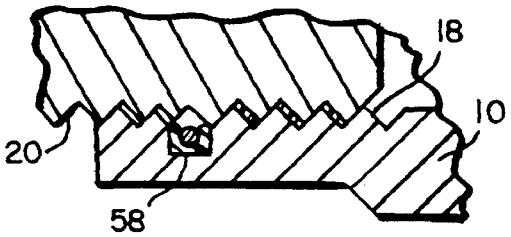

FIGS. 7, 7A, 8 and 8A disclose alternative embodiments of seal elements. In FIG. 7, the seal element comprises an annular ring 54 seated in a circular groove 56 located approximately midway along the length of the internal thread 18. The ring 54 is non-metallic, and as shown in FIG. 7A, is deformable by the male thread 20 with which the nut is engaged.

Figure 8:
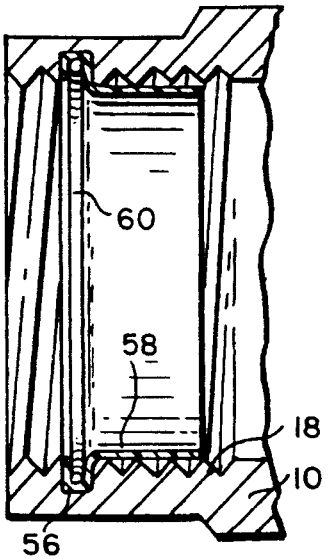

In FIG. 8, the seal element comprises a non-metallic deformable sleeve 58 of the type shown in FIGS. 1–6. Here, however, one end of the sleeve is deformed radially outwardly into the circular groove 56 by a snap ring 60. As shown in FIG. 8A, the sleeve 58 is again deformed into conformity with the internal thread 18 by the male thread 20 with which the nut is engaged.

From the foregoing detailed description, many variations within the scope of the invention will become apparent to those skilled in the art. It is therefore not intended that the drawings and foregoing description be taken in a limiting sense but rather that the scope of the invention be interpreted from the appended claims.

I claim:

1. A connector for connecting a coaxial cable to a system component, said connector comprising:

a connector body having a from end and a rear end, said rear end being adapted to axially inserted into an end of said cable;

means associated with the rear end of said connector body for securing said connector to said cable end;

a rotatable nut at the front end of said connector body, said nut having an internal thread with an axial length, pitch, thread angle and major and minor diameters configured and dimensioned to coact in threaded engagement with a complimentary external thread on said system component; and a circular seal element contained within and axially fixed with respect to said nut, said seal element being deformable into a configuration lining at least a substantial portion of said internal thread and a portion of said external thread to thereby establish a barrier to the penetration of moisture between said internal and external threads.

2. The end connector of claim 1 further comprising a circular groove interrupting said internal thread at a location intermediate the ends thereof, at least a portion of said seal element being seated in said groove.

3. The end connector of claim 2 wherein said groove has a maximum diameter which is greater than the major diameter of said internal thread.

4. The end connector of claims 2 or 3 wherein said seal element is axially at least partially confined within said groove.

5. The end connector of claim 1 wherein said seal element comprises a cylindrical sleeve.

6. The end connector of claim 5 wherein said sleeve is permanently deformed into conformity with the profile of said internal thread.

7. The end connector of claim 2 wherein said seal element comprises a cylindrical sleeve at least partially received in said circular groove.

8. The end connector of claim 7 further comprising means for resiliently urging said sleeve radially outwardly into said groove.

9. The end connector of claim 1 wherein said seal element in non-metallic.

10. The end connector of claim 9 wherein said seal element is radially expandable and permanently deformable.

11. The end connector of claims 9 or 10 wherein said seal element is polytetrafluoroethylene.

12. The end connector of claim 1 wherein said seal element is deformable radially outwardly beyond the minor diameter of said internal thread.

13. The end connector of claim 12 wherein said seal element is deformably radially outwardly to the major diameter of said internal thread.

14. The end connector of claim 1 wherein the axial length of said seal element exceeds the pitch of said internal thread.

* * * * *